United States Patent [19]

Ito et al.

[11] Patent Number: 4,541,154

[45] Date of Patent: Sep. 17, 1985

[54] HOOKED FABRIC FASTENER TAPE

[75] Inventors: Masahiko Ito; Toru Ogihara, both of Funabashi, Japan

[73] Assignee: Yoshida Kogyo K.K., Tokyo, Japan

[21] Appl. No.: 549,214

[22] Filed: Nov. 4, 1983

Related U.S. Application Data

[63] Continuation of Ser. No. 320,488, Nov. 12, 1981, abandoned.

[51] Int. Cl.[4] ..... A44B 13/00

[52] U.S. Cl. ..... 24/442; 24/444; 24/446; 24/447; 24/306; 428/100; 28/161

[58] Field of Search ..... 24/442, 306, 443, 444, 24/445, 446, 447, 448, 449, 450, 451, 452, 31 V, DIG. 18; 52/DIG. 15; 128/DIG. 13; 297/DIG. 6; 2/DIG. 6; 46/DIG. 1; 428/92, 99, 100; 28/161, 72 P

[56] References Cited

U.S. PATENT DOCUMENTS

| | | | |
|---|---|---|---|
| 3,009,235 | 11/1961 | De Mestral | 297/DIG. 6 |
| 3,114,951 | 12/1963 | De Mestral | 297/DIG. 6 |
| 3,128,514 | 4/1964 | Parker et al. | 24/306 |
| 3,135,820 | 6/1964 | Hallett, Jr. et al. | 24/306 |
| 3,346,904 | 10/1967 | Armstrong | 128/DIG. 15 |
| 3,368,811 | 2/1968 | Finney | 2/DIG. 6 |
| 3,658,107 | 4/1972 | Perina | 24/306 |
| 3,673,301 | 6/1972 | Billarant | 28/161 |
| 3,686,718 | 8/1972 | Brumlik | 24/306 |
| 3,708,382 | 1/1973 | Erb | 24/451 |
| 3,778,870 | 12/1973 | Bennett | 24/449 |
| 3,879,835 | 4/1975 | Brumlik | 24/444 |
| 4,165,555 | 8/1979 | Boxer et al. | 24/444 |
| 4,169,303 | 10/1979 | Lemelson | 428/100 |
| 4,344,654 | 8/1982 | Apezynski | 24/450 |

FOREIGN PATENT DOCUMENTS

| | | | |
|---|---|---|---|
| 2047243 | 12/1971 | France | 24/442 |
| 2243267 | 2/1967 | Japan | 28/161 |

*Primary Examiner*—Gene Mancene
*Assistant Examiner*—James Hakomaki
*Attorney, Agent, or Firm*—Robert E. Burns; Emmanuel J. Lobato; Bruce L. Adams

[57] ABSTRACT

A hooked fabric fastener tape has on one surface of a foundation structure a number of material engaging hooks which have been produced from and by cutting one of loops of synthetic resin threads woven into the foundation structure. One of the hooks is larger in height than the other hook so as to provide a large opening between the respective end portions thereof for easy reception of cooperating loops of mating looped fabric fastener tape. The hooks of different height are reliably engageable with any of the cooperating loops fanned apart on the looped fabric fastener tape.

5 Claims, 2 Drawing Figures

HOOKED FABRIC FASTENER TAPE

This is a continuation of application Ser. No. 320,488, filed Nov. 12, 1981, now abandoned.

BACKGROUND OF THE INVENTION

1. Field of the Invention

The present invention relates generally to surface type fasteners known as hook-and-loop fasteners, and more particularly to a fabric fastener tape carrying on its one surface a number of improved hook-shaped material engaging means.

2. Prior Art

According to a known method, a hooked fabric fastener tape of the type described has on one of opposite surfaces of a foundation structure a number of hook-shaped material engaging elements and stems which have been produced in pairs by cutting loops on the respective one leg sections thereof, the loops being made of synthetic resin monofilaments woven into the foundation structure and raising from said one surface thereof. The prior art hooked fabric fastener tape is disadvantageous in that the stems have their respective free ends disposed adjacent to and in substantially confronting relation to the free ends of the corresponding hook-shaped material engaging elements. Such stems have no function to hook the cooperating loops on a mating looped fabric fastener tape, or rather hinder the loops from being introduced into hooking engagement with the hook-shaped material engaging elements as the two fastener tapes are pressed into face-to-face contact together. As a result, the possibility of hooking between hooks and loops, i.e., the firmness of engagement of a hook-and-loop fastener decreases considerably.

SUMMARY OF THE INVENTION

According to the present invention, a hooked fabric fastener tape has on one surface of a foundation structure a number of material engaging means each comprising a pair of hooks which have been produced from and by cutting one of a plurality of loops of synthetic resin threads woven into the foundation structure. One of the hooks of each of the material engaging means is larger in height than the other hook so as to provide a large opening between the respective end portions thereof for easy reception of cooperating loops of a mating looped fabric fastener tape. The hooks of different height are reliably engageable with any of the cooperating loops fanned apart on the looped fabric fastener tape.

It is an object of the invention to provide a hooked fabric fastener tape for hook-and-loop fasteners which can adhere to or engage with a mating looped fabric fastener tape with an increased degree of firmness.

Another object of the invention is to provide a hooked fabric fastener tape having hook-shaped material engaging means which can hook cooperating loops of a mating looped fabric fastener tape reliably without causing mis-engagement therewith.

A further object of the invention is to provide a hooked fabric fastener tape having improved hooks reliably engageable with any cooperating loops fanned apart on a mating looped fabric fastener tape.

The above and other objects, advantages and features of the present invention will become apparent from the following description of preferred embodiments taken in conjunction with the accompanying drawings, in which:

DETAILED DESCRIPTION

Figure 1:
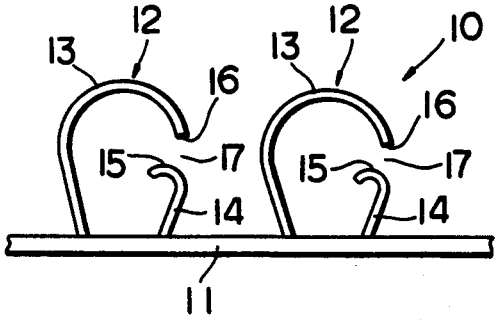
FIG. 1 is a fragmentary diagrammatic side elevational view of a hooked fabric fastener tape according to the present invention.

Referring now to the drawing, and more particularly to FIG. 1, there is shown a hooked fabric fastener tape 10 constructed in accordance with the present invention. The hooked fabric fastener tape 10 includes a foundation structure 11 and a number of material engaging means 12 projecting from one surface of the foundation structure 11. The foundation structure 11 is made by weaving together a weft thread and a plurality of warp threads in a well-known manner. Each of the material engaging means 12 comprises a pair of hooks 13,14 which have been produced from and by cutting one of the plurality of loops of synthetic resin threads woven, as a plurality of auxially warp threads, into the foundation structure 11 as the latter is woven, each of the loops including a pair of leg sections and a head section interconnecting the leg sections. The loops, hence the hooks 13,14 are preferably made of thermoplastic monofilaments.

One of the hooks 13 of each material engaging means 12 is larger in height than the other hook 14. The one or large hook 13 is formed jointly with one of the leg sections, the head section and a portion of the other leg section which has been cut whereas the other or small hook 14 is formed with the remainder of the other or cut leg section, the free end of the remainder leg being curved to formed a locking end portion 15. The locking end portion 15 of the small hook 14 is curved toward the large hook 13 and directed to the one surface of the foundation structure 11, thereby providing between the locking end portion 15 and the free end 16 of the large hook 13 a large opening 17 for easy reception of cooperating loops **18*a*,18*b* of a mating fabric fastener tape 19 shown by phantom lines in FIG. 2. Although such small hooks 14 as illustrated are very advantageous to give the hooked fabric fastener a maximum number of hooks per unit area, they may have their respective looking end portions curved into any directions with respect to the corresponding large hooks 13**.

Figure 2:
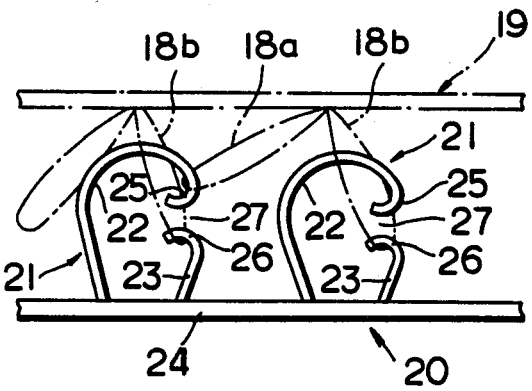
FIG. 2 is a view similar to FIG. 1, showing a modified hooked fabric fastener tape of the present invention which is brought into hooking engagement with a mating looped fabric fastener tape.

FIG. 2 shows a modified hooked fabric fastener tape 20 having material engaging means 21 each comprising a pair of hooks 22,23 projecting from one surface of a foundation structure 24, one of the hooks 22 being larger in height than the other hook 23. The small hooks 23 are the same as the small hooks 14 shown in FIG. 1, but the large hooks 22 are different from the aforesaid large hooks 13 in that their respective free ends or locking end portions 25 are curled so as to hold more securely the cooperating loops **18*a*,18*b* in hooking engagement therewith against force tending to separate the fabric fastener tapes 19,20. Provided between the locking end portion 25 and a locking end portion 26 of each small hook 23 is an opening 27 larger than the opening 17 shown in FIG. 1, the opening 27 allowing the cooperating loops 18*a*,18*b* of the looped fabric fastener tape 19 to enter more smoothly into hooking engagement with the hooks 22,23 as the two fastener tapes 19,20** are pressed together.

As best shown in FIG. 2, the hooked fabric fastener tape 20(10) of the invention can adhere to or engage with the mating looped fabric fastener 19 with an increased degree of firmness through the hooking engagement between, on one hand, the large hooks 13(22) and recumbent ones 18*a* of fanned-apart loops 18*a*,18*b* and, on the other hand, the small hooks 14(23) and relatively upstanding loops 18*b*. As will be seen in FIGS. 1 and 2 the monofilament forming the hooks, including end portions thereof, is of uniform size so that the ends of the hooks can readily penetrate the looped fabric fastener 19 so as to engage the loops 18*a* and 18*b* thereof.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A method of making a hook-type fastener tape for engagement with a loop-type fastener tape comprising a fabric base and a multiplicity of loops projecting from a face of said base at different angles and comprising loops having crests at different distances from said base, said method comprising weaving a foundation structure with a multiplicity of loops of thermoplastic synthetic resin monofilament projecting from one surface of said foundation structure, each of said loops including a pair of leg sections and a curved head section interconnecting said leg sections, cutting one leg section of each of a plurality of said loops of thermoplastic synthetic resin monofilament to provide a first curved hook formed jointly by the other of said leg sections, said curved head section and an upper part of said one leg section, with the remainder of said one leg section of each of said loops constituting a stem, and bending said stem over out of line with said upper part of said one leg section and toward said surface of said foundation structure to form a second curved hook smaller in height than said first hook and to provide an enlarged opening between said first hook and said second hook for reception of loops of said loop-type fastener tape the portion of said monofilament forming both of said hooks being of uniform size througout, said first hooks being engageable with loops of said loop-type fabric fastener tape having crests closer to said base and said second hooks being engageable with loops of said loop-type fabric fastener tape having crests farther from said base to join said hook-type fabric fastener tape securely with said loop-type fabric fastener tape.

2. A method according to claim 1 in which an end portion of said first hook is bent inwardly toward said other leg portion to form a curled locking end portion of said first hook and further enlarge the opening between said first hook and said second hook.

3. A method of making a hook-type fastener tape for cooperation with a loop-type fabric fastener tape comprising a fabric base and a multiplicity of loops projecting from a face of said base at different angles and comprising loops having crests at different distances from said base, said method comprising weaving a foundation structure with a multiplicity of loops of thermoplastic synthetic resin monofilament projecting from one surface of said foundation structure, each of said loops comprising a pair of leg sections extending away from said surface of said foundation structure and a curved head section interconnecting said leg sections, cutting one of said leg sections to provide a first curved hook formed jointly by the other of said leg sections, said curved head section and an upper part of said one leg section bending the remainder of said cut one leg section of each of said loops over toward said other leg section and directed toward said surface of said foundation structure to form a second curved hook smaller in height than said first hook and provide an enlarged opening between said first hook and said second hook for reception of loops of said loop-type fastener tape, said first hooks being engageable with loops of said loop-type fabric fastener tape having crests closer to said base and said second hooks being engageable with loops of said loop-type fabric fastener tape having crests farther from said base to join said hook-type fabric fastener tape securely with said loop-type fabric fastener tape.

4. A method according to claim 3, wherein an end portion of said first hook of said hooked fabric fastener tape is bent inwardly toward said other leg and curved toward said surface of said woven foundation structure, thereby further enlarging the opening between said first hook and said second hook.

5. A hook-type fastener tape made by the method defined in claim 3.

* * * * *